United States Patent [19]

Gray

[11] 4,146,496

[45] * Mar. 27, 1979

[54] PEROXY BLEACH SYSTEM SUITABLE FOR COLORED LAUNDRY

[75] Inventor: Frederick W. Gray, Summit, N.J.

[73] Assignee: Colgate-Palmolive Company, New York, N.Y.

[ * ] Notice: The portion of the term of this patent subsequent to Jun. 7, 1994, has been disclaimed.

[21] Appl. No.: 798,226

[22] Filed: May 18, 1977

[51] Int. Cl.[2] ..... C11D 7/56; C11D 7/38

[52] U.S. Cl. ..... 252/99; 252/95; 252/102; 252/186; 8/111

[58] Field of Search ..... 252/95, 96, 102, 186; 8/111

[56] References Cited

U.S. PATENT DOCUMENTS

| | | | |
|---|---|---|---|
| 3,321,497 | 5/1967 | Matzner | 252/95 |
| 3,556,711 | 1/1971 | Staiter | 8/111 |
| 3,652,660 | 3/1972 | Hardy | 252/95 X |
| 3,948,795 | 4/1976 | Kawabe et al. | 252/99 X |
| 4,006,092 | 2/1977 | Jones | 252/102 X |

*Primary Examiner*—Mayer Weinblatt

[57] ABSTRACT

There is disclosed a bleaching composition which includes an alkali metal peroxymonosulfate bleaching agent promoted by an effective amount of an alkali metal-N-bromo or N-dibromo aryl sulfonamide; the system is especially useful in conjunction with optical brighteners.

10 Claims, No Drawings

PEROXY BLEACH SYSTEM SUITABLE FOR COLORED LAUNDRY

This invention relates to a bleaching composition and more particularly, to a bleaching laundry detergent containing a halogen-promoted peroxymonosulfate bleach.

It has long been considered desirable to incorporate a bleaching agent in a laundry detergent so as to bleach out stains and soils; prior art bleaching agents have, however, had several disadvantages which have severely limited their use in laundry detergents. Many bleaching agents which contain or evolve chlorine produce offensive odors in use and hence are undesirable as components of laundry detergents. Other bleaching materials are such strong oxidizing agents that in laundry use they discolor dyed fabrics, even those dyed with so-called "colorfast" dyes. Still other prior art bleaching agents, such as inorganic peroxymonosulfate and perborate salts, are relatively weak and are inefficient for removing stains and soils when used under ordinary machine laundering conditions encountered in the United States. U.S. Pat. No. 3,458,446 teaches scouring compositions containing a detergent and a peroxymonosulfate bleach promoted by a water soluble bromide salt, such as sodium bromide. However, the abrasive constituents of the scouring compositions of the patent would preclude the use of such cleansers for washing fabrics or clothes, especially in modern washing machines, e.g., of the automatic types.

The desirability of bleaches, bleaching detergents, methods of bleaching and methods of simultaneously washing and bleaching being made safer to dyed materials being treated by such compositions or by such methods has long been recognized and much work has been done in attempts to produce effective bleaches which are safe to materials being treated. The problem is a difficult one because the mechanism of bleaching, usually oxidation, while effective in chemically changing objectionable colored stains to uncolored compounds or otherwise assisting in their removal from substrates, may have a similar effect on dyed or otherwise colored materials from which the removal of such dye color is undesirable. Therefore, for many years it has been customary to bleach only white goods and it has been reluctantly accepted that colored or dyed materials that have been stained will be incapable of being bleached back to unstained condition without dye changes. Despite the practical difficulties encountered, various stains are more susceptible to bleaching than are the dyes usually employed to color fabrics and therefore, if the strength of the bleach can be accurately controlled, it is theoretically possible for the stains to be bleached out while the dyed fabrics remain unaffected or sufficiently unaffected to be unobjectionable. Chlorine bleaches, such as sodium hypochlorite solutions, often lower brightener efficacy and adversely affect colors of dyed fabrics when they are used to remove stains from a washing machine load. Oxygen bleaches, e.g., sodium perborate, when employed at temperatures below the boil, often will not adversely affect dyed materials but because they are generally very weak bleaches unless activated, they will usually be unsatisfactory in their stain-removing properties. Activated peroxymonosulfates, such as those activated by sodium bromide, while usually effective bleaches and useful components of bleaching detergent compositions, can have detrimental effects on the more sensitive of the various dyes employed for coloring fabrics and textiles and can oxidize and destroy optical dyes or fluorescent brighteners, which are often desirably incorporated in bleaching compositions and in bleaching detergent compositions.

Therefore, it is an object of the present invention to produce an effective bleaching composition which will satisfactorily bleach or otherwise remove stains from stained fabrics without overbleaching of dyed materials also present in the bleaching medium.

It is another object of the invention to make such bleaching compositions which do not destroy dyes, such as fabric dyes and fluorescent brightening dyes, which may be employed in or with the bleaches.

Still another object of the invention is to prevent white fabrics from being stained by dye transfer or "bleeding" of dye onto them from colored items when white and colored items are washed together, more specifically, to prevent color damage and dye transfer problems associated with bleach sensitive dyed fabrics.

Other objects of the invention include the manufacture of bleaching detergent compositions similar to the bleaching compositions, in which a synthetic organic detergent, preferably built by a builder salt, is present with the previously mentioned bleaching composition.

Further objects and advantages include the discovery of methods of bleaching and simultaneously washing and bleaching fabrics and laundry with such compositions or the constituents thereof.

The above discussed disadvantages of the prior art are overcome by the present invention, which provides a bleaching and, if desired, brightening laundry detergent, preferably in particulate form, which has a promoted bleaching action (but slight, if any, deleterious effect on its preferred optical brightening constituents) on many dyed fabrics which are not adversely affected or bleached with a similar non-promoted peroxymonosulfate detergent.

Broadly speaking, this novel composition includes a bleaching composition comprising inorganic alkaline material containing (1) an alkali metal peroxymonosulfate bleaching agent promoted by (2) an effective amount of an alkali metal-N-bromo or N-dibromo aryl sulfonamide.

The invention more specifically relates to a bleaching composition comprising (1) a water soluble peroxymonosulfate and (2) a water soluble bromide of an N-hydrogen compound in sufficient quantity to promote the bleaching activity of the peroxymonosulfate and to inhibit destruction of dyes and overbleaching of dyed materials, while stains to be bleached by the composition are effectively removed from substrates.

The invention also relates to a bleaching detergent composition comprising a normally solid, water soluble synthetic organic detergent and the components of the described bleaching composition, preferably with a builder salt for the detergent also being present. Methods of bleaching and simultaneously washing and bleaching fabrics with the components of such compositions are also within the invention.

In particular embodiments of the various aspects of the invention a fluorescent brightener is present. In a preferred embodiment of the invention, the peroxymonosulfate bleach is potassium peroxymonosulfate, the bromide is para-potassium-N-bromo toluene sulfonamide, the fluorescent brigtener is a triazinylamino fluorescent brightener and, in the case of the bleaching detergent compositions, the synthetic organic detergent is a mixture of sodium linear higher alkylbenzene sulfonate and higher fatty alcohol polyethylene oxide condensate and the builder salt is pentasodium tripolyphosphate, sodium carbonate, sodium silicate, a zeolite molecular sieve or a mixture of any of these.

In accordance with this invention a bleaching composition consists essentially of an alkali metal peroxymonosulfate bleaching agent promoted by an effective bleach promoting amount of a compound selected from the group consisting of alkali metal N-monobromotoluene sulfonamides, alkali metal N-monobromobenzene sulfonamides and alkali metal N-monobromoethylbenzene sulfonamides wherein the alkali metal of the sulfonamides mentioned is selected from the group consisting of sodium and potassium and wherein the proportion of active oxygen from such sulfonamide is about 0.1 to two times that from the peroxymonosulfate. Corresponding bleaching detergent compositions are also within the invention, as are processes of utilizing such bleaching and bleaching detergent compositions.

Although it has been found that if the pH of a bleaching or bleaching detergent solution is maintained high, e.g., above 10.5, the "ordinary" fluorescent brighteners may still be sufficiently stable so as to be practicable, it has been desirable to apply them under conditions which further improve their brightening activities, even at elevated pH's and prevent decomposition at lower pH's, such as may often be encountered during bleaching and washing-bleaching operations. By means of the present invention such effects are obtained and the effectiveness of relatively low cost brighteners is much greater than can be obtained by direct use of a halogen bleach or one generated from peroxymonosulfate and sodium bromide.

The detergent composition is useful primarily for automatic laundry machine washing, including soiled clothing and various textile materials, but may also be used as a hard surface cleaner, a bleach or a laundry pre-soak. It may be employed as a powder in bulk in a pre-measured envelope or soluble container or as a tablet.

The bleaching agent utilized in the present bleaching compositions and bleaching detergents and corresponding processes is a water soluble peroxymonosulfate, normally an alkali metal peroxymonosulfate, such as potassium or sodium peroxymonosulfate. Potassium peroxymonosulfate, $KHSO_5$, is available as the mixed salt $2KHSO_5.KHSO_4.K_2SO_4$, sold by E. I. DuPont DeNemours and Company, Inc. under the trademark Oxone®. That product has an active oxygen content of about 4.5%. The active oxygen content of the mixed salt described is about 5.2% when the salt is pure and the corresponding active oxygen content of $KHSO_5$ is about 10.5%. Thus, the pure mixed salt has half as much active oxygen in it as the pure peroxymonosulfate and the 86.5% pure mixed salt (Oxone®) has 43% as much. In this specification when peroxymonosulfate is mentioned the single salt is intended, with its higher active oxygen content, but an equivalent proportion of the triple salt, such as that sold under the trademark Oxone®, will normally be employed as the source of the active bleaching compound because of its ready availability, stability and desirable physical characteristics. Potassium peroxymonosulfate may also be named as potassium monopersulfate and its triple salt may also be considered to be a monopersulfate compound within this invention.

The water soluble compound employed to promote the bleaching activity of the peroxymonosulfate bleaching agent is preferably an alkali metal-N-bromo aryl sulfonamide such as sodium or potassium-N-bromo toluene sulfonamide. The latter, which is very effective in the present compositions and processes, is especially preferred.

The N-bromo moiety therein promotes stain removal from substrates, aids in inhibiting destruction of coloring and fluorescent dyes and reduces the overbleaching of dyed materials. The combination of peroxymonosulfate and N-bromo compound may be with any of a wide variety of such moieties wherein an NH or $NH_2$ group with hydrogen replaced by bromide is present next to a strong electron-attracting $SO_2Ar$ grouping (Ar = aryl, preferably mononuclear), an N-bromo group is present next to an $SO_2$ and a carbonyl (C=O) group, or is present between two $SO_2$ functional groups. Usually the N-bromo moieties will contain in the range of 3 to 10 carbon atoms, preferably with 3 to 6 of these being in a heterocyclic or homocyclic ring. Of the described moieties, the most preferred are those derived from the sulfonamides, of which outstanding examples are the toluenesulfonamides. Examples of useful N-bromo moieties are alkali metal toluenesulfonamides, preferably sodium and potassium-N-bromo compounds of para-toluenesulfonamides and orthotoluenesulfonamides; N-bromo-benzenesulfonamide; N-bromo-para-ethylbenzenesulfonamide, and corresponding mono-alkali metal salts; N-bromo derivatives of N-acetyl and N-benzoyl mononuclear (preferably benzene and toluene) sulfonamides, such as N-acetyl-N-bromo-para-toluenesulfonamide, N-acetyl-N-bromobenzenesulfonamide, and N-benzoyl-N-bromo-benzenesulfonamide.

The ability of the alkali metal-N-bromo aryl sulfonamide activated peroxymonosulfate composition to bleach stained fabrics is dependent upon the amounts of halogen and peroxymonosulfate present in the composition and the use conditions. For strong, efficient bleach promotion, the mole ratio of active oxygen to alkali halogen moiety in a peroxymonosulfate detergent is at about unity, e.g., 0.9 to 1.1. Usually the weight or molar proportion of active oxygen from the N-brominated sulfonamide is from 0.1 to 2 times that from the peroxymonosulfate bleach. Machine washing in the United States utilizes about 0.1 to 0.2% of detergent composition in a 10–20 minute machine wash cycle at 80°–140° F. In Europe, higher concentrations of detergent and higher wash temperatures, for example, 0.5 to 0.8% detergent at temperatures of 140° to 200° F. or over are common and the wash period may extend to for 0.5 to 1 hour. With the proportions of the halogen salt promoter and the peroxymonosulfate in the above described amounts, it is possible to incorporate promoted peroxymonosulfate together with brightening agents into a laundry detergent which brightens and bleaches laundry efficiently. The promoted bleaching detergent composition is substantially inert toward the preferred optical brighteners.

Various fluorescent brighteners, sometimes called optical brighteners or optical dyes, may be incorporated in the present bleaching and bleaching detergent compositions and processes. The more stable fluorescent brighteners, such as the chlorine-stable brighteners, which can be effective fluorescent brightening materials in the presence of hypochlorite bleach, are still effective in the presence of the controlled bleaching composition of this invention. Thus, commercial triazolyl brighteners BHC, RBS-200 and CBS, the formulas of which are given in U.S. Pat. No. 4,028,263 (corresponding to application Ser. No. 391,058), the specification of which is incorporated herein by reference, are useful, but because they are expensive it is much preferred to employ ordinary brighteners of types which are usually susceptible to degradation in the presence of strong bleaches, such as chlorine bleaches. Among such materials are the triazine brighteners, 4,4'-bis-(4-anilino-6-methylethanol-S-triazin-2-ylamino)-2,2'-stilbenedisulfonic acid, disodium salt (Tinopal 5BM Conc.); 4,4'-bis-(4-anilino-6-morpholine-S-triazin-2-ylamino)-2,2'-stilbenedisulfonic acid, disodium salt (Calcofluor White RC or Stilbene 4); and 4,4'-bis-(4-anilino-6-diethanol-S-triazin-2-ylamino)-2,2'-stilbenedisulfonic acid, disodium salt (Calcofluor CG or Stilbene 3). Although the described compounds are disodium salts, other salts thereof may also be employed, such as other alkali metal salts, e.g., dipotassium salts and monosodium and monopotassium salts, other triazine fluorescent dyes of similar structure, wherein at the 6-position of the triazine moiety there are present other lower alkyl lower alkanol and di-lower alkanol groups, of 1 to 4 carbon atoms each, instead of the alkanol substituents on the Tinopal 5BM Conc. and Calcofluor CG, respectively. Also, instead of morpholine, various such alkyl-substituted morpholine derivatives may be used. The stability of the fluorescent dye components of the present compositions in aqueous media is good over the usual pH ranges confronted by the instant invention, e.g., 8.0–11.

In addition to the specifically mentioned fluorescent brighteners and classes thereof recited, other useful brighteners which may be utilized in the present invention and are not in the class of highly stable or chlorine stable brighteners include the various commercial brighteners presently in detergents, which are usually of the stilbene, triazine or morpholine types, preferably morpholine or triazine stilbene disulfonic acids or alkali metal salts thereof.

The bleaching compositions of this invention and the materials employed in the bleaching processes may comprise only those previously mentioned, the peroxymonosulfate, alkali-metal-N-bromo or dibromo aryl sulfonamide, with or without fluorescent brightener but usually there will be present with such materials filler salts and/or builder salts and various adjuvants. Such materials will be described after recitation of the various additional components of the bleaching detergents (other than those already mentioned as being in the bleaching compositions).

The detergent compositions of the invention usually include as a primary detersive constituent a water soluble synthetic anionic detergent salt selected from the group consisting of organic sulfonates, sulfates, phosphates and phosphonates but the anionic detergent(s) can be supplemented, or if desired, replaced entirely by water soluble organic nonionic detergent(s). Such suitable detergents are described in *McCutcheon's Detergents and Emulsifiers* 1969 Annual (also for 1973) wherein such compounds are listed by chemical formulas and trade names. Additional suitable detergents of the aforementioned types are also described in the text. *Surface Active Agents and Detergents,* Vol. II, by Schwartz, Perry and Berch (Interscience Publishers, 1958). In short, useful anionic materials include hydrophilic and lipophilic groups, the lipophilic portions of which normally contain a higher hydrocarbyl chain, usually of 10 to 20 carbon atoms and the hydrophilic portions of which include a salt-forming ion, preferably an alkali metal cation, and an acid group of the mentioned class. Among such useful detergents the organic sulfonates and sulfates are preferred (especially the former) but corresponding organic phosphonates and phosphates are also useful. Suitable anionic detergents, include, for example, higher alkyl benzene sulfonates (some of these are not usually sufficiently biodegradable to be accepted in modern detergent formulations); higher olefin sulfonates; higher alkyl sulfonates; higher paraffin sulfonates; higher alcohol sulfates; including sulfated derivatives of higher polyhydric alcohols which are incompletely esterified with higher fatty acids; and the sulfates of condensates of higher alcohols and lower alkylene oxides and glycols, i.e., alkylene oxides and glycols of 2 to 4 carbon atoms such as ethylene oxide, propylene oxide, ethylene glycol, butylene glycol and the like. The higher hydrocarbyl, alkyl and higher fatty acyl groups of such compounds will generally be of 12 to 18 carbon atoms and the salt-forming cations thereof will preferably be alkali metal cations, e.g., sodium and potassium, with ammonium, amine and alkanolamine sometimes also being useful to form the desired salts. The sodium salts tend to make harder detergent products which are more freely flowing and have lesser tendency to cake, which is important because the compositions of this invention are desirably free flowing particulate materials.

Among the preferred organic sulfonate detergents, linear higher alkyl aromatic sulfonates, preferably those wherein the aromatic group is phenyl, are utilized and linear tridecyl benzene sulfonates, usually as the sodium salt, are especially preferred. Of these materials it is highly preferred to employ the linear higher alkyl benzene sulfonates wherein the alkyl substituents are of 12 to 18 carbon atoms, especially of 12 to 15 carbon atoms, and in which the salt-forming cation is alkali metal, especially sodium, e.g., sodium linear tridecyl benzene sulfonate. However, the alkali metal sulfates or lower alkoxylated, e.g., ethoxylated, higher fatty alcohols and middle ($C_{7-9}$) alkyl phenols are also useful. In such aliphatic and aromatic compounds there will usually be from 3 to 20 lower alkoxy groups present.

The nonionic detergents employed in various of the above-described preferred embodiments of the invention are usually poly-lower alkoxylated lower alkanols of lipophilic moieties, wherein the lower alkoxies and alkanols are of 2 to 3 carbon atoms, preferably 2, and the lipophiles are from higher alkanols, middle alkyl (7 to 9 carbon atoms) phenols or polypropylene oxide condensates. The nonionic detergents include higher alkyl poly-lower alkoxylates or, in other words, higher alkyl poly-lower alkoxy alcohols, i.e., the condensation products of higher fatty alcohols with lower (2–4 carbon atoms) alkylene glycols and/or with lower alkylene oxides, such as ethylene oxide or propylene oxide (mostly ethylene oxide in all such cases), as exemplified by Neodol® 45-11, Plurafac® B-26 and Alfonic® 1618-65. Such products are normally near-liquid or semi-solid at room temperature but can be "solidified" by the other components of the described compositions. Also useful are the block copolymers of propylene glycol, propylene oxide and ethylene oxide, such as those sold as Pluronics®, e.g., Pluronic F-68, and the middle alkyl phenyl polyoxyethylene ethanols, such as those sold as Igepals®. Preferably, the nonionic detergent that will be utilized in the invention is a higher linear alkyl polyethoxy ethanol. The number of carbon atoms in the higher alkyl group averages from 8 to 20, preferably from 12 to 15 and especially from 14 to 15 and the molar ratio of ethoxy groups to higher alkyl groups is usually from 3 to 20, preferably 9 to 13 and especially preferably about 11.

The builder salts which are employed in the invention are well known in the laundry detergent art and generally exert a desirable effect in overcoming water hardness and in increasing the cleaning ability of the organic detergent. In the present products they also help to impart a desirably alkaline pH to a bleach medium or water water, generally about 7 or 8 to 10 or 11 and advantageously about 9 to 10, e.g., about 9.5. Suitable builder salts include water soluble salts having inorganic anions, e.g., pyrophosphates, tripolyphosphates, orthophosphates, silicates, carbonates, sequicarbonates, bicarbonates, borates and the like, as well as water soluble salts having organic anions, such as tartrates, citrates, gluconates and salts of other hydroxy acids. Nitrogen-containing sequestrants and builders, such as NTA, EDTA and hydroxyethyliminadiacetates are sometimes avoided because of stability problems encountered or possibly harmful effects thereof on humans but may be sometimes used in suitable formulations. The cations associated with the above described inorganic and organic anions in the builder salt are preferably alkali metal cations, e.g., sodium and/or potassium. Preferable builder salts of the invention are selected from the readily available and inexpensive pyrophosphates, e.g., tetrasodium pyrophosphate; tripolyphosphates, e.g., pentasodium tripolyphosphate; citrates, e.g., sodium citrate; bicarbonates, e.g., sodium bicarbonate, potassium bicarbonate; carbonates, e.g., sodium carbonate, potassium carbonate; silicates, e.g., silicates having an $Na_2O:SiO_2$ ratio of 1 to 2.4; and trisodium nitrilotriacetate (except where nitrogen-containing materials are to be avoided), but various other builders known in the art are also useful.

The use of an inert, water soluble filler salt is desirable in both the bleaching and laundry detergent formulations and in the corresponding processes. In the mentioned products the filler salt employed should be at least substantially free of any halide anions and preferably completely free of such ions. It is highly preferable that on solution in aqueous media none of the filler salt ionizes to chloride or bromide anions because in the presence of peroxymonosulfate salt bleaching agent chloride anion may be oxidized to elemental chlorine, which is undesirable and bromide anion from the filler salt might well make the content of bromide, together with that from the promoter bromide salt, sufficient to overpromote the peroxymonosulfate bleach, possibly producing deleterious effects on the optical brightener constituents and/or on dyed fabrics being treated. A preferred halide-free filler salt is an alkali metal sulfate, e.g., sodium or potassium sulfate. Sodium sulfate is especially good and is usually present in the product in anhydrous form or only to a minor extent, e.g., less than 10% thereof, as a hydrate.

Both the inorganic filler and builder salts help to make the present compositions free flowing particulate materials but the filler (sodium sulfate, anhydrous) is especially desirable in the products when the builder salt includes a major proportion of sodium silicate or NTA, both of which may be less free flowing and moisture sorptive (without caking) than polyphosphates and carbonates. The alkali metal silicates exert desirable alkalinizing effects, inhibit corrosion, help to counteract water hardness and have independent detersive effects and the property of improving the detersive actions of the anionic and nonionic detergents and combinations thereof. The alkali metal silicates which are preferred constituents of the detergent and bleach compositions are of the formula $M_2O:SiO_2$, wherein M represents alkali metal, e.g., sodium or potassium, most preferably sodium, and the ratio of $M_2O:SiO_2$ is in the range of 1:1 to 1:3, preferably 1:2 to 1:2.5, especially about 1:2.4.

Together with the foregoing components of the present bleaching and bleaching detergent compositions there may be present additional minor adjuvants which impart certain functional or esthetic properties to the products. In general, these include perfumes; water soluble dyes; water dispersible pigments; long chain fatty acid soaps, i.e., alkali metal salts of $C_{10}$ to $C_{18}$ alkanoic and alkenoic acids, such as tallow and coconut oil fatty acids, the former types being especially useful as antifoaming agents and detergents; organic gum antiredeposition agents, such as the alkali metal carboxymethyl cellulose salts, especially sodium carboxymethyl cellulose, polyvinyl alcohol, polyvinyl pyrrolidone and polyacrylamide; foam improvers, such as lauric myristic diethanolamide; foam destroyers, such as silicones; fungicides, such as the polyhalosalicylanilides; flow improving agents, such as the clay product commercially sold under the trade name "Satintone"; and an odor stabilizer or malodor-inhibitor, such as Iphol. Iphol is a mixture of 2-methyl-4-isopropyl phenol and 2-methyl-6-isopropyl phenol and is the product of the reaction of orthocresol with isopropanol in the presence of phosphoric acid. Of course, the various adjuvant materials will be selected for the properties desired in the finished products and to be compatible with the other constituents thereof, which means that some of them may be suitable for use only with one or the other of the bleach and bleaching detergent compositions.

The "equivalent" proportions of active oxygen derived from peroxymonosulfate ($KHSO_5$) and alkali metal-N-bromo or N-dibromo aryl sulfonamide will usually be in the range of about 0.5 to 2:0.05 to 2 and preferably are about 1 to 1:0.3 to 0.7.

On a weight basis, in which allowances sometimes will be made due to different molecular weights, the proportions are about 5 to 30:2 to 30, respectively, preferably to 10 to 25:4 to 25 ($KHSO_5$: alkali metal-N-halogen aryl sulfonamide). It will be evident that when a commercial material such as Oxone® is employed as a source of peroxymonosulfate the proportion thereof required to provide the desired amount of active oxygen will be greater than that indicated above, due to the fact that Oxone® is only about 43% as effective as pure peroxymonosulfate. When fluorescent brightener is present in the bleaching composition, the proportion thereof by weight will usually be in the range of about 0.5 to 10, preferably 0.5 to 2, with the other proportions of components previously given. Thus, a typical preferred bleaching composition with fluorescent brightener may be of relative proportions of about 15:8:1.5 and such proportions will be about 15:8 without the brightener content.

For the bleach compositions described, the proportions given may be considered as parts or percentages in the final product, with the balance of such a product usually comprising inert filler salt, builder salt and adjuvants. The adjuvant content will usually not exceed about 20% of the product, preferably is less than about 10% thereof and more preferably is less than about 5%. The balance of the bleach composition may be a mixture of filler salt and builder salt or all of one or the other types. However, the ratios of such materials will normally be about 5–85, preferably 20–65 of filler salt and 0 to about 60, preferably 10 to 50 of builder salt. Thus, a typical bleaching composition may include about 10 or 15 parts (or percent) of peroxymonosulfate, 8 parts of alkali-metal-N-bromo aryl sulfonamide, about 1.5 parts of fluorescent brightener (which may sometimes be omitted), about 5 parts of adjuvant(s), about 48.5 or 53.5 parts of builder salt (because it is desirable to have it contribute its alkalinity to make the bleach or wash water pH about 9 or more, e.g., 9–10.5) and about 10 to 15 parts of filler salt (or 25 parts of the builder salt may be replaced by filler salt). In the above formulas when Oxone ® or similar multiple salt is employed as a source of peroxymonosulfate, the "inactive" balance of the salt $K_2SO_4$ and $KHSO_4$, is considered to be part of the filler salt content of the product (note the correspondence in amounts of peroxymonosulfate and filler above).

The bleaching detergent compositions of this invention include about 5 to 50 parts, preferably 10 to 25 parts, of synthetic organic detergent and about 10 to 100 parts, preferably 20 to 50 parts of builder salt. The parts or percentages of inorganic filler salt will be about the same as those of the builder salt and, of course, in some cases where a lighter duty bleaching detergent is being manufactured, the builder salt may be omitted. When nonionic detergent is present it will preferably be limited to about 10% of the composition, more preferably to about 4% and most preferably to about 2% thereof, especially if it is of liquid, pasty or soft waxy characteristics. Similarly, the sodium silicate content of the final products should be limited to about 25%, preferably being less than 15%.

A typical bleaching detergent composition of this invention contains about 5 to 25% of peroxymonosulfate bleach, 2 to 20% of alkali metal-N-bromo aryl sulfonamide, 5 to 30% of anionic detergent, 0.0 to 10% of nonionic detergent, 10 to 60% of filler salt, 0.1 to 2% of fluorescent brightener and less than 5% of adjuvants. Preferably, such composition will contain about 5 to 15% of potassium peroxymonosulfate, 4 to 15% alkali metal-N-bromo aryl sulfonamide, 5 to 15% of sodium linear higher alkylbenzene sulfonate in which the higher alkyl is of 12 to 15 carbon atoms, 0.0 or 0.5% to 2% of polyethoxylated higher fatty alcohol nonionic detergent, the higher alcohol portion of which is of 12 to 15 carbon atoms and the ethylene oxide portion of which is a chain 7 to 20 ethylene oxide units long, 15 to 40% of sodium sulfonate (mostly) filler (including about 5 to 15% of potassium sulfate and potassium bisulfate from the multiple salt containing the potassium peroxymonosulfate), 15 to 30% of pentasodium tripolyphosphate, 3 to 10% of sodium silicate of $Na_2O:SiO_2$ ratio of about 1:2.4, 0.1 to 2%, preferably 0.5 to 1.5% of one or more of the preferred Tinopal 5BM Conc., Stilbene 3 and Stilbene 4 brighteners and about 0.1 to 1% or 2% of adjuvants. The builder may also include borax, $Na_2CO_3$ and molecular sieves, with the former normally being about 0.5 to 10% of the product and with the others being about 5 to 30% thereof, when present, with each being a replacement of about equal parts of other builder and filler salts. Of course, if lesser or greater extents of bleaching are desired, the contents of the bleaching components, the peroxymonosulfate and alkali metal-N-bromo aryl sulfonamide, may be diminished or increased about 50%, but normally the proportions and percentages will be in the ranges previously given.

The compositions of this invention may be advantageously prepared by mixing of the various powdered components and spraying onto the surfaces of a tumbling mixture thereof any suitable liquid ingredients. However, it is preferred to spray dry the major proportion of the mixture, including the alkali metal-N-halogen aryl sulfonamide, when sufficiently stable, into characteristic globular particles, to which perfume, peroxymonosulfate salt or a source thereof, such as Oxone ®, may subsequently be added. Conveniently, before drying, agitation is accomplished in a conventional soap crutcher over a suitable time period, e.g., three minutes to one hour, at a temperature ranging from room temperature or a moderately elevated temperature to about 80° or 90° C. The aqueous mixture is then converted to a particulate solid by spray drying. According to a normally employed spray drying technique the aqueous mixture is forced through restricted orifices, for example, of cross-sectional area equivalent to a circular passage of 1 to 5 mm. in diameter, at a high pressure, e.g., 200 to 1,000 lbs./sq. in., so as to result in production of a spray of aqueous droplets. The droplets are allowed to fall through a spray drying tower, wherein they are contacted with a countercurrent or concurrent flow of hot drying air. The drying operation will be controlled, as by regulation of drying gas temperatures and tower throughput rates, to make detergent particles of a desired moisture content, generally in the range of about 2 to 10%, preferably 4 to 10%, e.g., 4 to 6%. It is then preferred for the spray dried particles to be screened and sized to obtain product particles in about the 6 to 140 mesh range (U.S. Standard Sieve Series). Preferably, the product will pass completely through a No. 8 screen and no more than 10% will pass through a No. 100 screen. Also preferably, it will have a cup weight of between 50 and 150 grams, more preferably about 75 grams, weights which correspond to bulk densities of 0.21 to 0.63 g./ml., preferably 0.32 g./ml. Subsequently, if desired, perfume may be added by spraying onto the detergent and a desiccant material, such as sodium sulfate or magnesium sulfate, may also be admixed with it. Any other adjuvants which are sensitive to elevated temperature, particularly in aqueous media, or part or all of any constituent of the composition, may be added after the spray drying step if it is considered to be advantageous to do so with respect to the particular formulation. The particulate product is then charged to a tumbling drum for admixing with the peroxymonosulfate salt, the particle size of which will preferably approximate that of the base detergent to which it is being added. Flow-improving clay, e.g., Satintone ®, may also be added.

The procedure followed for the manufacture of the present products is the same for both bleaching compositions and bleaching detergents but in some cases it is preferable merely to blend together previously size-reduced powders, preferably of the sizes given but such blending may also be employed when the peroxymonosulfate and/or the alkali metal-N-bromo aryl sulfonamide is/are encapsulated or otherwise stabilized to prevent premature reactions.

The bleaching compositions and the components of them may be used in normal manner for the bleaching of stains from white and colored goods in the presence or absence of ordinary fluorescent brighteners. Normally the materials treated are fabrics or articles made from fabrics, some of which have been stained with organic soils and/or food stains, e.g., wine, coffee, tea, chocolate, ice cream, grape juice, clay, carbon. The fabrics are usually of cotton, polyester or cotton-polyester blends, with the blends having a proportion of cotton in the range of 10 to 90%, preferably 35 to 70%. However, the compositions may also be used to treat other fabrics, such as nylon, wool and rayon, to mention only a few. The bleaching composition may also be employed to bleach stains from various other substrates, as from walls, floors, tiles, linoleums, painted surfaces, etc. It may also be employed as an antibacterial or sterilizing agent. The bleaching detergent compositions may be utilized similarly or in a combination of washing and bleaching processes and may be employed to wash and bleach stained fabrics or other surfaces, such as those mentioned. In the bleaching method the various components of the bleaches previously described are usually employed at a total concentration of such materials in an aqueous medium (water) which is about 0.01 to 2%, normally from 0.05 to 1%. The temperature of the aqueous medium will be about 50° to 158° F., preferably 104° to 140° F. and the time of bleaching will be from five minutes to three hours, preferably from 5 minutes to 30 minutes or one hour. The weight proportion of fabrics treated to aqueous medium will usually be about 1 to 30%, preferably from 5 to 20%. For washing and bleaching at the same time the described composition or the components thereof are usually employed at a concentration of about 0.02 to 1%, preferably about 0.1 to 0.2% in American practice and about 0.4 to about 1% in European practice. The temperatures and times for treatment are about the same as previously mentioned for bleaching as will be the weight of material being washed and bleached per weight of aqueous medium. The pH of the wash water will normally be in the range of about 7 or 7.5 to 11, preferably 8 to 10 and most preferably about 9 or 9.5 to 10 and similar pH's will be used for bleaching, although for such they may be diminished by one pH unit, while not being less than about 7. In a preferred embodiment of the invention the aqueous wash medium comprises about 0.01 to 0.05% of sodium linear higher alkylbenzene sulfonate, the higher alkyl of which is of 12 to 15 carbon atoms, 0.002 to 0.01% of higher fatty alcohol-polyethylene oxide condensate, the higher fatty alcohol of which is of 12 to 15 carbon atoms and the ethylene oxide portion of which is a chain 7 to 20 ethylene oxide units long, 0.002 to 0.02% of potassium peroxymonosulfate, 0.004 to 0.01% of alkali metal-N-bromo aryl sulfonamide, 0.02 to 0.1% or 0.2% of a mixture of sodium carbonate, sodium tripolyphosphate and sodium silicate builder salts and 0.0005 to 0.003% of 4,4'-bis-(4-anilino-6-methyl-ethanol-S-triazin-2-ylamino)-2,2'-stilbene-disulfonic acid, disodium salt. Such concentrations may be increased proportionately for European practice.

The following examples illustrate the invention but do not limit it. Unless otherwise indicated, all parts and percentages are by weight and temperatures are in ° F. herein.

EXAMPLE I

A spray dried detergent product (A) having the following composition is prepared, using the standard spray drying conditions previously described.

| | Percent |
|---|---|
| Linear sodium alkylbenzenesulfonate with the alkyl group of 12–15 carbon atoms, averaging about 13. | 25.0 |
| Neodol 45-11 (a primary alkanol of 14–15 carbon atoms ethoxylated with 11 moles of ethylene oxide per mole of alkanol), made by Shell Chemical Co. | 4.0 |
| Sodium soap (a mixture of coconut and tallow fatty acid salts in an acids ratio of about 15:85) | 1.0 |
| Sodium silicate ($Na_2O:SiO_2$ ratio = 1:2.35) | 25.0 |
| Sodium carboxymethyl cellulose (CMC) | 2.0 |
| Brighteners: Tinopal 5BM Conc. | 0.70 |
| Stilbene 4 | 0.23 |
| Tinopal RBS-200 | 0.05 |
| Sodium sulfate | 35.0 |
| Water | 5.0 |
| Minor adjuvants [0.1 to 1% each of dye, perfume (0.3%), stabilizer (to prevent development of odor) and anti-caking agent] | q.s. |

The product is of 8 to 140 mesh particle size with less than 10% passing a 100 mesh sieve. The perfume is sprayed onto the tumbling beads after cooling thereof after spray drying. Particle sizes remain the same.

To a control washing solution containing 1.5 g of Example 1 detergent (A) in 1 liter of 120° F. water there is added either

| | PPM. A.O. |
|---|---|
| B. 0.04 g para-potassium -N-bromo toluene sulfonamide (hereafter "Br-TSA") | 2.2 |
| C. 0.25 g Oxone ® + 0.10 g $Na_2CO_3$ | 10.8 |
| D. 0.04 g Br-TSA + 0.25 g Oxone + 0.10 g $Na_2CO_3$. | 13.0 |

The formulas made are identified as (B), (C) and (D).

In one set of experiments, standard coffee-tea, red wine (Empa 114) and sulfo dyed bleach test cloth (Empa 115) are agitated with non-stained white fabric in a tergotometer for 15 minutes at 120° F. Stain removal as indicated by increase in reflectance (ΔRd) is determined from Rd cloth readings taken on a Gardner Color Difference Meter before and after washing. The pH of the solutions at the end of the wash is 9.3.

| | Stain Removal, Δ Rd | | | Non-stained |
|---|---|---|---|---|
| Wash | Coffee/Tea | Empa 114 | Empa 115 | White |
| (A) | 1.8 | 9.9 | 1.0 | −0.6 |
| (B) | 1.1 | 8.9 | 1.3 | −0.2 |
| (C) | 1.8 | 10.9 | 1.2 | −0.3 |
| (D) | 5.7 | 13.1 | 2.6 | −0.2 |

In another set of experiments, to the wash solutions of A–D described above, there is added clean, white cotton and highly color fugitive blue corduroy fabric and they are agitated together for 15 minutes at 120° F. Instrumental readings indicative of dye transfer onto white (the more negative the ΔRd and Δb values the greater the discoloration) and fading of blue corduroy (the more positive the ΔRd and Δb values the greater the loss in blueness) for the systems are given below:

| | White Fabric | | Blue Corduroy | |
|---|---|---|---|---|
| Wash | Δ Rd | Δ b | Δ Rd | Δ b |
| (A) | −34.0 | −17.2 | 3.4 | −3.3 |
| (B) | −4.0 | −1.9 | 5.9 | −2.9 |
| (C) | −32.7 | −16.4 | 3.3 | −3.0 |
| (D) | −2.2 | −1.5 | 7.4 | −2.6 |

Visually: White fabric washed in A or C is uniformly and intensely blue from dye transfer whereas washes in B or D resulted in very little discoloration of white. Some loss in depth of color or fading of the dyed fabric is evident for all washes. Dyed fabric washed in B or D is only slightly less blue than fabric washed in A or C.

From the foregoing data it is apparent that the instant bleach system (D) causes slightly greater loss in color intensity of dyed fabric than does a peroxymonosulfate system (C) but it removes stains and inhibits dye transfer much better than (C). It is apparent therefore that in wash solutions containing a small amount of Br-TSA relative to Oxone, the two bleaching agents complement each other to provide good stain removal. Concomitantly, for washes containing mixed colored and white articles, discoloration of white by dye transfer is minimal, if any, as is also the color damage to the dyed fabric itself compared to use of detergent without bleach, (A).

EXAMPLE 2

A spray dried detergent formula (E) having the following approximate composition is prepared by the method described in Example 1.

| | Percent |
|---|---|
| Linear sodium alkylbenzenesulfonate (alkyl group averaging about 13. carbon atoms) | 10.0 |
| Neodol 45-11 | 2.0 |
| Sodium soap (a mixture of coconut tallow fatty acid salts of a 15:85 coconut oil:tallow mix) | 1.0 |
| Sodium silicate ($Na_2O:SiO_2$ = 1:2.35) | 7.0 |
| Tetrasodium pyrophosphate | 38.0 |
| Sodium carboxymetnyl cellulose | 0.5 |
| Phorwite BHC 766 (Verona) | 0.28 |
| Water | 7.5 |
| Perfume | 0.3 |
| Sodium sulfate | q.s. |

The foregoing detergent (E) is used in place of detergent (A). Wash test experiments give similar results for the bleaching of stained fabrics.

EXAMPLE 3

In this example, a spray dried detergent (F) of the commercial Fab ® type but without brightener or anti-redeposition agent is prepared and employed together with Br-TSA. Its composition is essentially 21.0% linear sodium tridecylbenzenesulfonate, 35.5% sodium tripolyphosphate, 7.0% sodium silicate ($Na_2O:SiO_2$=1:2.35), 1.0% borax, 27% sodium sulfate and 8.5% water. The same good results obtain.

EXAMPLE 4

Practical laundry testing of six-pound loads of white laundry that are stained and soiled under ordinary home use is conducted. In addition, the laundry contains two coffee-tea stained cloths, an Empa bleach test cloth 115, (U.S. Testing Company) and a non-brightened white percale swatch, each of which are 15 inch squares. The laundry, with the test swatches, is washed for 10 minutes in a Kenmore automatic washing machine. Detergents containing the instant bleach (Br-TSA) are used at 0.2% concentration in 17 gallons of 120° F. wash water of 150 p.p.m. hardness, as calcium carbonate. The same good results obtain.

EXAMPLE 5

The practical laundry test of Example 4 is repeated except detergent E of Example 2 replaces the detergent of Example 4 and three test swatches (five inch squares) cut from each of the following dyed fabrics are included in the wash.

(1) Cotton, dyed with 5% Calcoloid Blue BLR:
(2) Spun nylon, dyed with 1% Calcocid Alizarine Blue SAPG;
(3) Spun nylon, dyed with 1% Calcocid Milling Yellow R; and
(4) 50% Polyester, 50% cotton, dyed pink.

The same good results obtain.

EXAMPLE 6

The procedures of Example 1 are repeated except that there is employed a different heavy duty built synthetic detergent composition. Such detergent is a spray dried product containing 15% of sodium linear tridecylbenzene sulfonate, 32% of phosphate solids (from pentasodium tripolyphosphate), 31.8% of sodium sulfate, 7% of sodium silicate ($Na_2O:SiO_2$=1:2.35), 1% of polyethoxylated alcohol ($C_{14-15}$ fatty alcohol mix and 11 mols of ethylene oxide per mole of alcohol), 1% of borax (as $Na_2B_4O_7.10H_2O$), 0.01% of Iphol preservative, 0.3% of sodium carboxymethyl cellulose, 0.2% of perfume, 0.05% of Tinopal RBS 200, 0.55% of Stilbene No. 4, 0.1% of Tinopal 5BM Conc. and 11% of water. The pH of a 1% solution of the detergent is about 10. The same good results obtain.

EXAMPLE 7–9

The procedure of Example 1 is repeated except that para-N-dibroma-toluenesulfonamide; para-sodium-bromo-toluenesulfonamide; and para-sodium-N-bromo-benzenesulfonamide, respectively are employed. The same good results obtain.

When, in any of the preceding examples, variations are made in composition components, within the ranges previously described, satisfactory cleaning, bleaching and brightening are obtained, also without damage to the materials washed and without objectionable changes in the colors thereof. Thus, when various phosphate builders are interchanged, little difference in bleaching or brightening is observable. The proportions of silicate may be increased and the type of silicate may be changed. Instead of sodium carbonate, in high builder content formulas, sodium bicarbonate may be employed. Instead of the described synthetic organic detergents, other alkali metal salts, e.g., potassium salts, may be utilized and in place of the alkyl benzene sulfonates there may be substituted paraffin sulfonates, olefin sulfonates, higher fatty alcohol sulfates, sulfated ethoxylated higher fatty alcohols or suitable mixtures thereof. Likewise, the nonionic may be replaced by others named or described herein, e.g., Plurafac B-26, Pluronic F-68, Igepal CO-630 or other Plurafacs, Pluronics, Igepals, or Alfonics or similar compounds. Similarly, instead of sodium carboxymethyl cellulose other anti-redeposition agents or gums may be employed, e.g., polyvinyl alcohol, polyvinyl pyrrolidone, hydroxypropylmethyl cellulose. Finally, the physical form may be changed to a pressed tablet, a pre-measured charge in a water-soluble package or other suitable form and/or the product may be employed as a straight bleach, hard surface cleaner or laundry presoak, with similar good results. In such cases of interchange essentially the same detersive, bleaching and brightening effects result, as they do when modifications of the formulas are made within the proportional range previously given and with equivalent or alternate compounds being employed.

The physical properties and stabilities of the present detergents and bleach formulations are satisfactory for commercial applications. The particulate products are sufficiently free flowing and do not objectionably cake upon storage. Although bleach products are usually sensitive to the presence of moisture, the present product can tolerate the mentioned proportions of moisture in the beads thereof, providing that a satisfactory barrier type carton is employed to prevent transmission of moisture to the detergent composition from high humidity surroundings. Of course, after use, the carton of detergent should be closed tightly to prevent any deterioration thereof.

The invention has been described with respect to examples and illustrations thereof but is not limited to these because it is evident that one of ordinary skill in the art to which the invention pertains will be able to utilize substitutes and equivalents without departing from the spirit of the invention or the scope of the claims.

I claim:

1. A bleaching composition consisting essentially of an alkali metal peroxymonosulfate bleaching agent promoted by an effective bleach promoting amount of a compound selected from the group consisting of alkali metal N-monobromotoluene sulfonamides, alkali metal N-monobromobenzene sulfonamides and alkali metal N-monobromoethylbenzene sulfonamides wherein the alkali metal of the sulfonamides mentioned is selected from the group consisting of sodium and potassium and wherein the proportion of active oxygen from such sulfonamide is about 0.1 to two times that from the peroxymonosulfate.

2. A composition according to claim 1 wherein the sulfonamide is a monobromo-para-toluene sulfonamide.

3. A composition according to claim 1 which includes an effective brightening proportion, between 0.5 and 10 parts, of a fluorescent brigthener selected from the group conisting of 4,4'-bis-(4-anilino-6-alkyl-alkanol-S-triazin-2-ylamino)-2,2'-stilbenedisulfonic acid, alkali metal salt, 4,4'-bis-(4-anilino-6-morpholino-S-triazin-2-ylamino)-2,2'-stilbenedisulfonic acid, alkali metal salt, 4,4'-bis-(4-anilino-6-morpholino-S-triazin-2-ylamino)-2,2'-stilbenedisulfonic acid, alkali metal salt and 4,4'-bis-(4-anilino-6-dialkanol-S-triazin-2-ylamino)-2,2'-stilbenedisulfonic acid, alkali metal salt, wherein the alkyls and lower alkyls are of 1 to 4 carbon atoms, with 5 to 30 parts of alkali metal peroxymonosulfate bleaching agent and 2 to 30 parts of said alkali metal-N-monobrominated sulfonamide.

4. A composition according to claim 3 wherein the sulfonamide is potassium N-monobromo-para-toluene sulfonamide, the proportions of alkali metal peroxymonosulfate bleaching agent and said sulfonamide are about 10 to 25:4 to 25 and the peroxymonosulfate is in $2KHSO_5.KHSO_4.K_2SO_4$.

5. A bleaching detergent composition consisting essentially of a normally solid, water soluble synthetic organic detergent selected from the group consisting of anionic and nonionic detergents and an effective bleaching proportion of a bleaching composition consisting essentially of an alkali metal peroxymonosulfate bleaching agent promoted by an effective bleach promoting proportion of a compound selected from the group consisting of alkali metal N-monobromotoluene sulfonamides, alkali metal N-monobromobenzene sulfonamides and alkali metal N-monobromoethylbenzene sulfonamides wherein the alkali metal of the sulfonamides is selected from the group consisting of sodium and potassium, wherein the proportion of active oxygen from the sulfonamide is from about 0.1 to two times that from the peroxymonosulfate and in which bleaching detergent composition the proportions of peroxymonosulfate bleaching agent, N-monobrominated sulfonamide and synthetic organic detergent are about 5 to 50, 2 to 30 and 5 to 50, respectively.

6. A bleaching detergent composition according to claim 5 wherein the monobrominated sulfonamide is a monobromo-para-toluene sulfonamide, the bleaching agent is potassium peroxymonosulfate and there is also present in the composition from 10 to 100 parts of a water soluble alkali metal builder salt selected from the group consisting of pyrophosphates, tripolyphosphates, orthophosphates, silicates, carbonates, sesquicarbonates, bicarbonates, borates, tartrates, citrates and gluconates.

7. A detergent composition according to claim 6 wherein the synthetic organic detergent includes a mixture of anionic and nonionic detergents, the anionic detergent being a sodium linear higher alkylbenzene sulfonate wherein the alkyl group is of 12 to 15 carbon atoms and the nonionic detergent being a higher fatty alcohol polyethylene oxide condensate wherein the higher fatty alcohol is of 12 to 15 carbon atoms and the number of mols of ethylene oxide per mol is from 7 to 20, and which detergent composition consists essentially of 5 to 25% of alkali metal peroxymonosulfate bleach, 2 to 20% of alkali metal-N-brominated sulfonamide, 5 to 30% of anionic synthetic organic detergent, 0.5 to 10% of nonionic synthetic organic detergent, 10 to 60% of filler salt selected from the group consisting of sodium sulfate and sodium chloride and 0.1 to 2% of fluorescent brightener selected from the group consisting of 4,4'-bis-(4-anilino-6-alkyl-alkanol-S-triazin-2-ylamino)-2,2'-stilbenedisulfonic acid, alkali metal salt, 4,4'-bis-(4-anilino-6-morpholino-S-triazin-2-ylamino)-2,2'-stilbenedisulfonic acid, alkali metal salt, 4,4'-bis-(4-anilino-6-alkyl-morpholino-S-triazin-2-ylamino)-2,2'-stilbenedisulfonic acid, alkali metal salt and 4,4'-bis-(4-anilino-6-dialkanol-S-triazin-2-ylamino)-2,2'-stilbenedisulfonic acid, alkali metal salt, wherein the alkyls and alkanols are of 1 to 4 carbon atoms.

8. A detergent composition according to claim 7 consisting essentially of about 5 to 15% of potassium peroxymonosulfate in the mixed salt $2KHSO_5.KHSO_4.K_2SO_4$, 4 to 15% of potassium N-monobromo-para-toluene sulfonamide, 5 to 15% of sodium linear higher alkylbenzene sulfonate, 0.5 to 2% of nonionic detergent, 15 to 40% of sodium sulfate, 15 to 30% of pentasodium tripolyphosphate, 3 to 10% of sodium silicate of $Na_2O:SiO_2$ ratio of about 1:2.4 and 0.5 to 1.5% of fluorescent brightener.

9. A method of bleaching laundry fabrics which comprises bleaching said fabrics in an aqueous medium having present therein an effective bleaching proportion of a bleaching composition selected from the group consisting of alkali metal N-monobromotoluene sulfonamides, alkali metal N-monobromobenzene sulfonamides and alkali metal N-monobromoethylbenzene sulfonamides wherein the alkali metal of the sulfonamides mentioned is selected from the group consisting of sodium and potassium, wherein the proportion of active oxygen from such sulfonamide is about 0.1 to two times that from the peroxymonosulfate, in which the concentration of active oxygen in the aqueous medium from the bleaching agent and the bleach promoter is about 10 to 50 p.p.m., the temperature of such aqueous medium is in the range of about 10° to 70° C., the pH thereof is in the range of 7 to 11 and the time of contact of the fabric with said bleaching medium is about 5 minutes to three hours.

10. A method of washing and bleaching laundry fabrics which comprises immersing said fabrics in an aqueous medium having present therein an effective detergent and bleaching amount of a composition consisting essentially of a normally solid, water soluble synthetic organic detergent selected from the group consisting of anionic and nonionic detergents and an effective bleaching proportion of a bleaching composition consisting essentially of an alkali metal peroxymonosulfate bleaching agent promoted by an effective bleach promoting proportion of a compound selected from the group consisting of alkali metal N-monobromotoluene sulfonamides, alkali metal N-monobromobenzene sulfonamides and alkali metal N-monobromoethylbenzene sulfonamides wherein the alkali metal of the sulfonamides is selected from the group consisting of sodium and potassium, wherein the proportion of active oxygen from the sulfonamide is from about 0.1 to two times that from the peroxymonosulfate and in which bleaching detergent composition the proportions of peroxymonosulfate bleaching agent, N-monobrominated sulfonamide and synthetic organic detergent are about 5 to 50, 2 to 30 and 5 to 50, respectively.

* * * * *